US010611505B2

(12) United States Patent
Ampolini et al.

(10) Patent No.: US 10,611,505 B2
(45) Date of Patent: Apr. 7, 2020

(54) DISPENSING MACHINE FOR AEROSOL PRECURSOR

(71) Applicant: R. J. Reynolds Tobacco Company, Winston-Salem, NC (US)

(72) Inventors: Frederic Philippe Ampolini, Winston-Salem, NC (US); James Demopoulos, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 762 days.

(21) Appl. No.: 14/703,171

(22) Filed: May 4, 2015

(65) Prior Publication Data

US 2016/0325858 A1 Nov. 10, 2016

(51) Int. Cl.

| | |
|---|---|
| ***B65B 3/14*** | (2006.01) |
| ***A24F 47/00*** | (2020.01) |
| ***B65B 31/00*** | (2006.01) |
| ***B65D 83/14*** | (2006.01) |
| ***B65B 29/10*** | (2006.01) |
| ***B65B 11/52*** | (2006.01) |
| ***B65B 3/00*** | (2006.01) |
| ***B65B 59/00*** | (2006.01) |

(52) U.S. Cl.

CPC ..... *B65B 3/14* (2013.01); *A24F 47/008* (2013.01); *B65B 3/003* (2013.01); *B65B 11/52* (2013.01); *B65B 29/10* (2013.01); *B65B 31/00* (2013.01); *B65B 59/00* (2013.01); *B65D 83/752* (2013.01); *B65B 2210/04* (2013.01); *B65B 2220/14* (2013.01); *B65B 2220/16* (2013.01); *B65B 2230/02* (2013.01)

(58) Field of Classification Search

CPC ..... B65B 3/14; B65B 3/003; B65B 11/52; B65B 29/10; B65B 31/00; B65B 59/00; B65B 2210/04; B65B 2220/14; B65B 2220/16; B65B 2230/02; A24F 47/008; B65D 83/752

USPC ..... 53/411

See application file for complete search history.

(56) References Cited

U.S. PATENT DOCUMENTS 2,193,059 A * 3/1940 Chapman ..... B65B 3/003 141/275

4,598,833 A 7/1986 Herr (Continued)

FOREIGN PATENT DOCUMENTS

| | | |
|---|---|---|
| CN | 2117327 U | 9/1992 |
| EP | 3023947 | 5/2016 |

(Continued)

*Primary Examiner* — Nathaniel C Chukwurah
*Assistant Examiner* — Lucas E. A. Palmer
(74) *Attorney, Agent, or Firm* — Womble Bond Dickinson (US) LLP

(57) ABSTRACT

A machine for dispensing an aerosol precursor composition for use with aerosol delivery devices. The machine may include a plurality of sources of dispensable, liquid aerosol precursor components. The plurality of sources may differ in the liquid aerosol precursor components being dispensable therefrom. The machine may include a user interface configured to allow a user to select an amount of the liquid aerosol precursor components for dispensing. The machine may also include a dispenser for dispensing the aerosol precursor components in response to the selection made on the user interface.

20 Claims, 7 Drawing Sheets

(56) References Cited

U.S. PATENT DOCUMENTS 4,782,644 A * 11/1988 Haarer ..... A24C 5/00 53/253
5,372,148 A * 12/1994 McCafferty ..... A24F 47/008 128/202.21
6,267,297 B1 * 7/2001 Contadini ..... A61L 9/12 222/646
6,293,316 B1 9/2001 Bertolotti et al.
6,718,222 B2 4/2004 Bergo et al.
7,124,883 B1 * 10/2006 Thomas ..... B65D 43/162 206/256
7,260,447 B2 8/2007 Osborne
7,565,818 B2 * 7/2009 Thomas ..... A24C 5/06 65/70
9,445,631 B1 * 9/2016 Patel ..... A24F 23/00
9,497,993 B2 * 11/2016 Vallar ..... A24B 15/00
9,695,033 B1 * 7/2017 Alshouse ..... B67D 7/302
9,828,170 B2 * 11/2017 Nomura ..... B65D 83/752
2003/0069667 A1 * 4/2003 Dirksing ..... A45D 40/00 700/233
2004/0189311 A1 * 9/2004 Glezer ..... B01L 3/5027 324/444
2005/0016550 A1 * 1/2005 Katase ..... A24F 47/002 131/194
2005/0269367 A1 * 12/2005 Post ..... B01F 13/1058 222/185.1
2007/0163574 A1 * 7/2007 Rohrschneider .. A61M 15/0045 128/200.19
2007/0175908 A1 * 8/2007 Siri ..... B65D 47/20 220/714
2008/0053560 A1 * 3/2008 Hartman ..... B65B 3/003 141/2
2008/0206751 A1 * 8/2008 Squirrell ..... B01J 19/0046 435/6.18
2011/0036346 A1 * 2/2011 Cohen ..... A61M 15/0065 128/200.14
2012/0018034 A1 * 1/2012 Bertoli ..... B01F 13/1058 141/9
2012/0048266 A1 * 3/2012 Alelov ..... A61M 11/005 128/202.21
2012/0152406 A1 * 6/2012 Bartholomew ..... B65B 3/04 141/104
2012/0167906 A1 * 7/2012 Gysland ..... A24F 47/008 131/328
2013/0146489 A1 * 6/2013 Scatterday ..... A24F 15/20 206/247
2013/0158704 A1 * 6/2013 Hughes ..... B08B 3/02 700/239
2013/0255831 A1 * 10/2013 Shibasaki ..... A61J 1/00 141/69
2013/0338821 A1 * 12/2013 Igarashi ..... B67D 7/08 700/233
2013/0340390 A1 * 12/2013 Carson ..... B25J 9/0096 53/411
2014/0007836 A1 1/2014 Miyajima et al.
2014/0123990 A1 * 5/2014 Timmermans ..... A24F 47/008 131/328
2014/0203063 A1 7/2014 Hessler et al.
2014/0270727 A1 * 9/2014 Ampolini ..... A24F 47/008 392/387
2014/0283946 A1 * 9/2014 Kribs ..... B65D 47/06 141/2
2015/0027436 A1 1/2015 Mine et al.
2015/0028815 A1 1/2015 Osawa et al.
2015/0040568 A1 2/2015 Stastny et al.
2015/0166253 A1 * 6/2015 Nomura ..... B65B 31/003 222/402.1
2015/0191266 A1 * 7/2015 Holmes ..... A24F 47/008 141/86
2015/0264319 A1 9/2015 Wood et al.
2015/0336689 A1 * 11/2015 Brown ..... B65B 3/12 141/98
2016/0054345 A1 * 2/2016 Watson ..... B01L 3/0217 73/864.11
2016/0143361 A1 * 5/2016 Juster ..... A24F 47/008 392/404
2016/0200463 A1 * 7/2016 Hodges ..... G07F 13/02 53/415
2017/0000191 A1 * 1/2017 Medina Rivero ..... A61M 15/06
2017/0121169 A1 * 5/2017 Dailey ..... A24F 47/002

FOREIGN PATENT DOCUMENTS

GB 2296911 7/1996
GB 2497536 6/2013
WO WO 2006/052863 5/2006
WO WO 2015/028815 3/2015
WO WO 2016/179155 11/2016

* cited by examiner

DISPENSING MACHINE FOR AEROSOL PRECURSOR

FIELD OF INVENTION

The present disclosure relates to aerosol precursor compositions and a machine configured to at least dispense aerosol precursor. The aerosol precursor may be of the type that incorporates materials that may be made or derived from tobacco or otherwise incorporate tobacco. The precursor is intended to be capable of forming an inhalable substance for human consumption when in-use with an aerosol delivery device, such as smoking articles. Smoking articles may be the type that utilizes electrically generated heat for the production of the inhalable substance.

BACKGROUND

Many smoking articles have been proposed through the years as improvements upon, or alternatives to, smoking products that require combusting tobacco. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. No. 8,881,373 to Collett et al, U.S. patent application Ser. No. 13/432,406, filed Mar. 28, 2012, U.S. patent application Ser. No. 13/536,438, filed Jun. 28, 2012, and U.S. patent application Ser. No. 13/647,000, filed Oct. 8, 2012, which are incorporated herein by reference.

Some of these alternative smoking articles, i.e. aerosol delivery devices, are reusable by employing replaceable cartridges or refillable tanks of aerosol precursor (e.g. smoke juice, e-liquid, or e-juice). It would be desirable to provide for a personalized selection of aerosol precursor for use with these alternative smoking articles. Thus, advances with respect to dispensing, cartridge filling, and cartridge packaging of aerosol precursor would be desirable.

SUMMARY

The present disclosure relates to a machine for dispensing aerosol precursor for use in aerosol delivery devices.

Embodiments of the present disclosure include a machine for dispensing an aerosol precursor composition for use with aerosol delivery devices. The machine may comprise a plurality of sources of dispensable, liquid aerosol precursor components where the plurality of sources differ in the liquid aerosol precursor components dispensable therefrom. The machine may also include a user interface configured to allow a user to select an amount of the liquid aerosol precursor components for dispensing. A dispenser configured to dispense the aerosol precursor components in response to the selection made on the user interface may be included as part of the machine.

In some embodiments the machine may include at least one source of an aerosol former, where the aerosol former comprises a material selected from the group consisting of polyols, water, and combinations thereof. At least one source of the machine may include a flavoring agent, and at least one source may include a nicotine source. The plurality of sources may include replaceable pre-filled storage modules insertable into the machine, and containing an aerosol precursor component. In other embodiments the plurality of sources may include refillable storage tanks disposed within the machine. In yet other embodiments, the plurality of sources may include an inlet in operable communication with an external source.

The dispenser can be configured to dispense the aerosol precursor components in a manner that the selected components mix to form the customizable aerosol precursor composition. Alternatively, the dispenser can be configured to dispense the aerosol precursor components in a manner that the selected components remain separate until combined during use of the aerosol delivery device.

The machine may dispense the aerosol precursor components into at least one reservoir of a cartridge based upon the user selection. The dispenser may use at least one pipette assembly to dispense the aerosol precursor components. Empty cartridges can be stocked within the machine. A cartridge transport system may position one or more empty cartridges in relation to the dispenser to accept the dispensed aerosol precursor components. The machine may stock empty cartridges of a plurality of cartridge sizes or types, and the user interface may allow the user to select a preferred cartridge to be filled. In some embodiments, the machine has a programming unit to program the cartridge with use parameters to optimize performance of the cartridge based on the aerosol precursor composition provided.

Embodiments of the machine may have a packaging system for packing one or more cartridges having received the selectively dispensed aerosol precursor components. A tray portion and a cover film may be stocked within the machine for use in the packaging system to create a blister pack. In example embodiments, the packaging system includes a sealing sub-system to seal the cover film to the tray portion. In certain embodiments, the packaging system provides packages containing more than one cartridge, each cartridge sealed in a respective cup of the blister pack. In some embodiments the machine further comprises a printing sub-system configured to print a label to accompany the packaged cartridges.

The present disclosure also describes embodiments of a method of forming an aerosol precursor composition. The method may include making a selection from a machine comprising a plurality of sources of dispensable, liquid aerosol precursor components, the plurality of sources differing in the liquid aerosol precursor components dispensable therefrom, wherein making the selection comprises, using a user interface of the machine to define a custom combination of the aerosol precursor components from the plurality of sources. The method may also include dispensing the aerosol precursor composition formed of the custom combination of the aerosol precursor components arising from the selection made on the user interface.

In some embodiments, the step of dispensing further comprises dispensing the aerosol precursor from a filling head into a reservoir within a cartridge usable with an aerosol delivery device. The method may include a step of packaging the cartridge after the cartridge receives aerosol precursor from the filling head. In some embodiments making the selection comprises selecting an aerosol former of the custom combination. In an embodiment, making the selection comprises selecting a relative amount of nicotine within the custom combination. In another embodiment making the selection comprises selecting at least one flavoring agent for use within the custom combination.

BRIEF DESCRIPTION OF THE DRAWINGS

Figure 1:
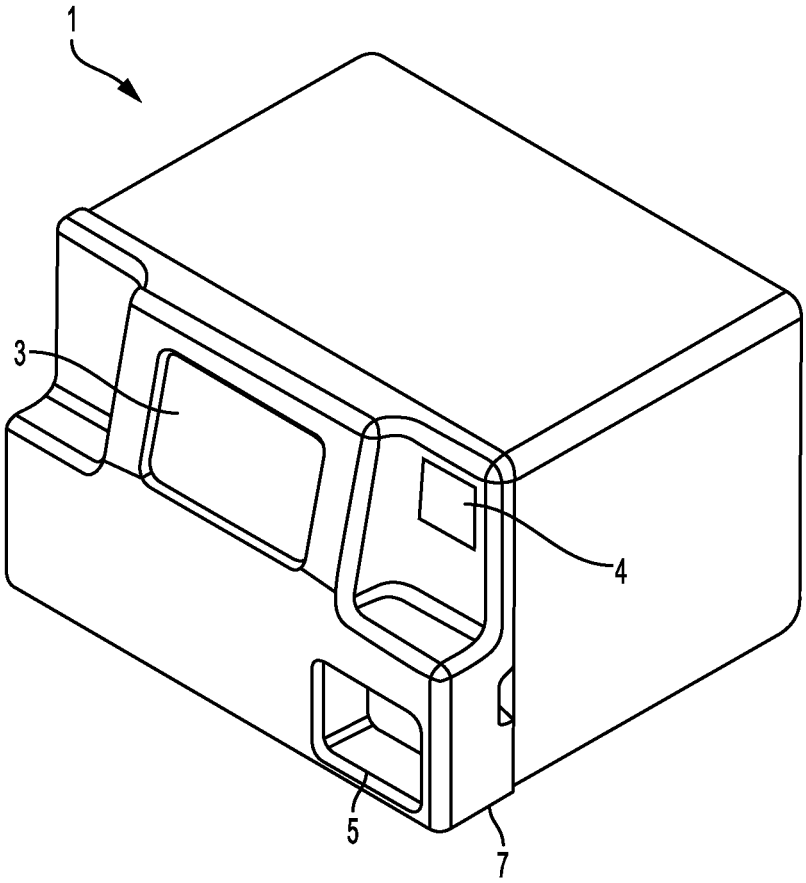

Having thus described the disclosure in the foregoing general terms, reference will now be made to the accompanying drawings, which are not necessarily drawn to scale, and wherein:

FIG. 1 is exterior view of a dispensing machine according to embodiments of the present disclosure.

Figure 2:
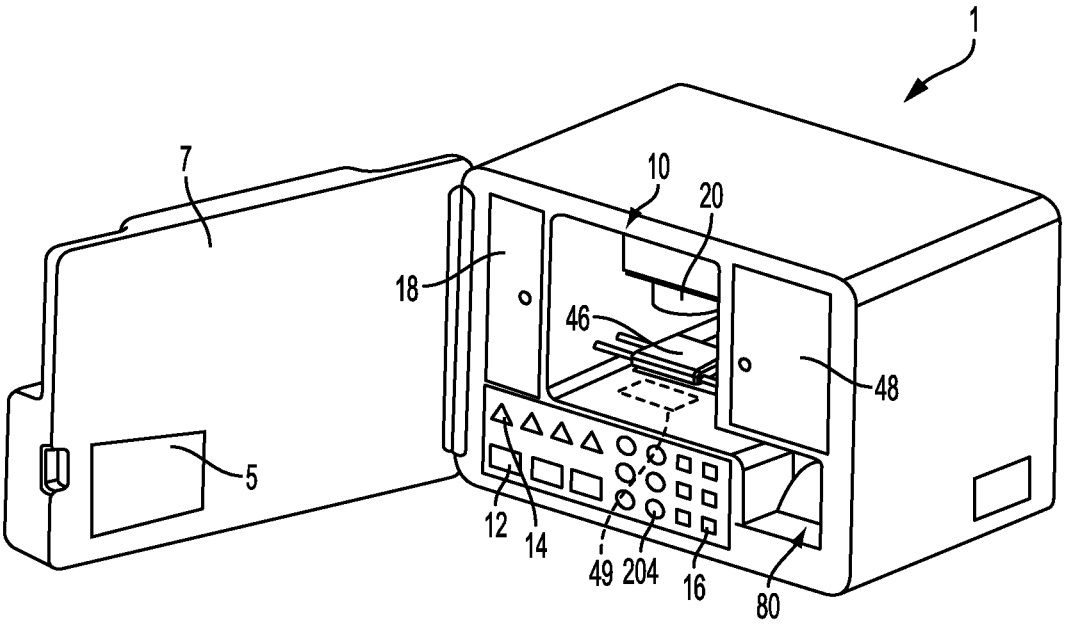

FIG. 2 is an interior view of a dispensing machine according to embodiments of the present disclosure.

Figure 3:
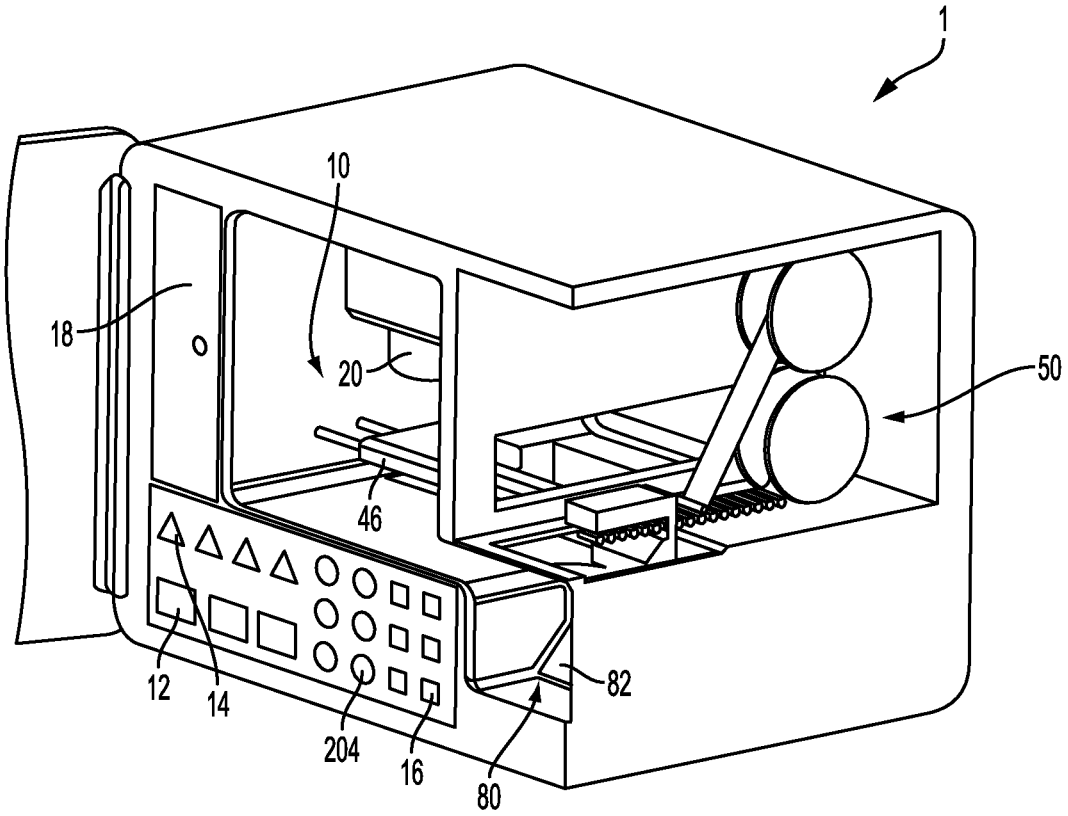

FIG. 3 is an interior cutaway view of a dispensing machine according to embodiments of the present disclosure.

Figure 4:
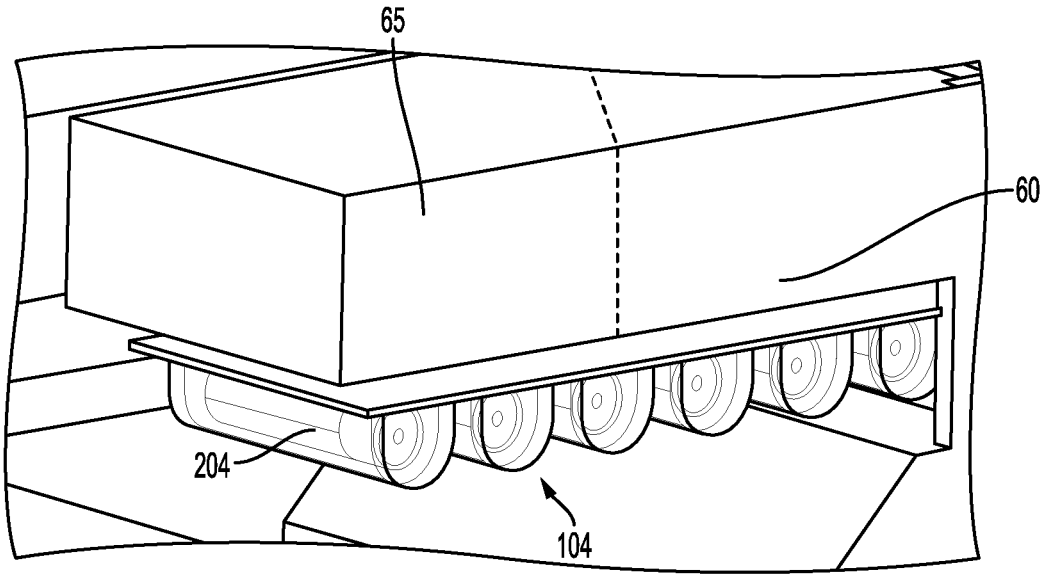

FIG. 4 shows an example sealing sub-system for use in the machine of FIG. 1.

Figure 5:
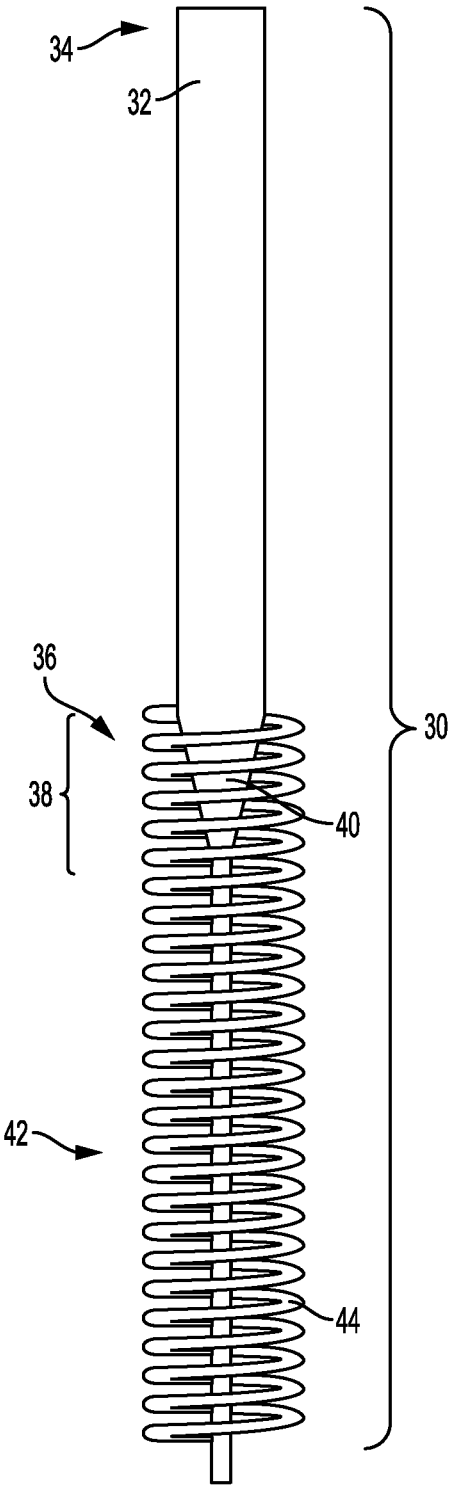

FIG. 5 shows an example pipette for use within the machine of FIG. 1.

Figure 6:
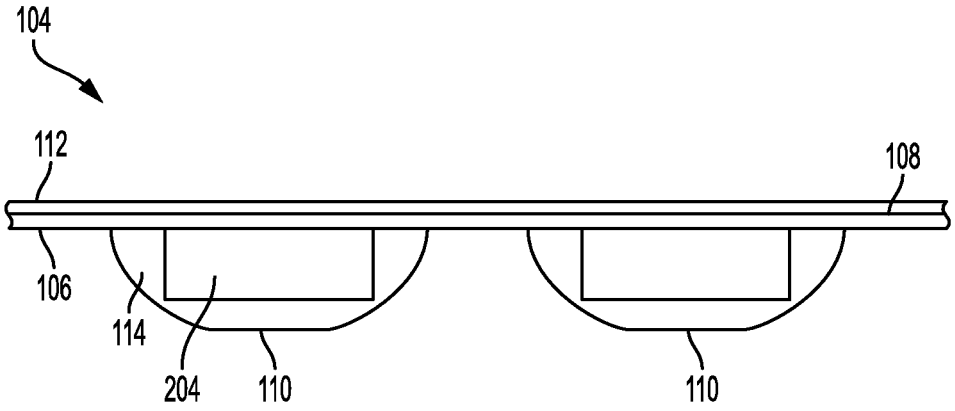

FIG. 6 shows an example blister pack package dispersible from the machine of FIG. 1.

Figure 7:
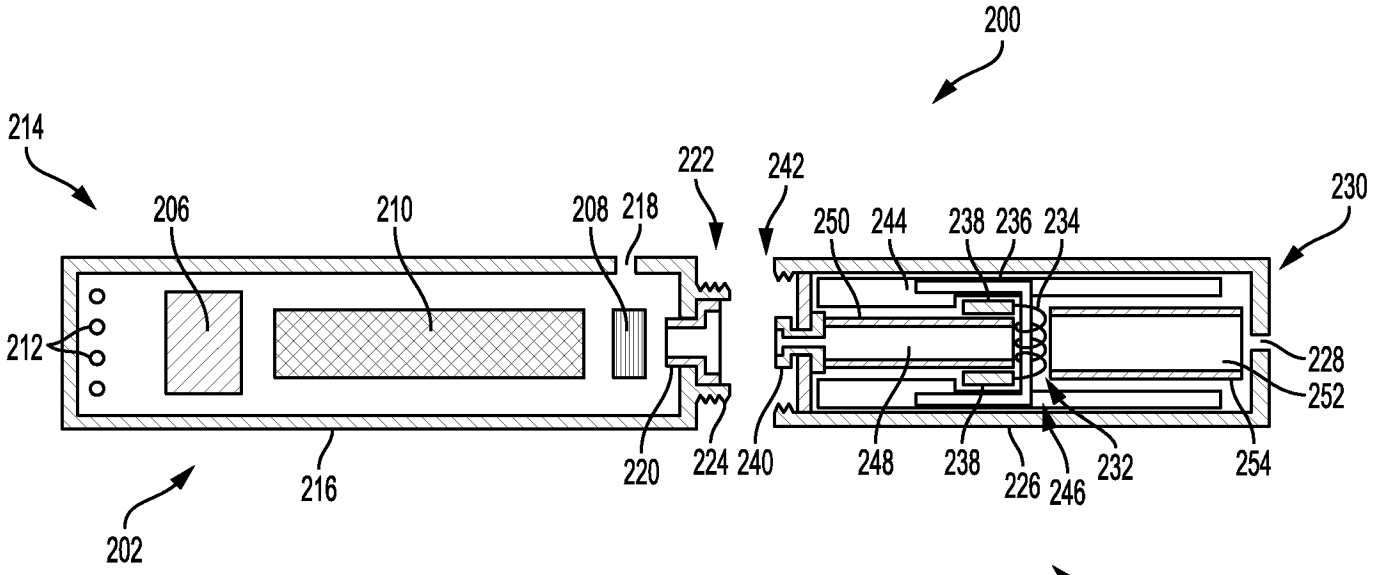

FIG. 7 shows an embodiment of an example cartridge dispensed by the machine of FIG. 1 and configured for attachment to a control unit to form an aerosol delivery device.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Turning to FIG. 1, embodiments of the present disclosure relate to machine 1. The machine 1 may be interchangeably referred to as a dispensing machine. In one embodiment the machine 1 is customer or clerk operated to perform at least one of the tasks of dispensing customized aerosol precursor, filling cartridges with customized aerosol precursor, and packaging cartridges filled with customized aerosol precursor. The terms "precursor", "aerosol precursor", "aerosol precursor composition" and "aerosol precursor formulation" are generally used interchangeably to refer to combined ingredients intended for use to produce aerosol or the like from aerosol delivery devices 200, such as smoking articles (e.g. electronic cigarettes). An example aerosol delivery device 200 is shown in FIG. 7 and discussed in detail below. The precursor may also be known in the industry by the terms smoke juice, e-juice or e-liquid.

The machines according to embodiments of this disclosure are intended to be relatively small in size, potentially capable of placement on a desk or counter, for operation by a retail clerk, or properly screened customer. The machines are configured to dispense precursor substantially on demand. The precursor may be considered "customized" or "personalized" because the precursor dispensed from the machines for one user can vary from the precursor dispensed from the machines for the next user. In some embodiments, these differences arise because the precursor may be formulated on-demand based on user selectable parameters.

The machine 1, in FIG. 2, may include a user interface 3 provided in any easy to locate and easy to operate position on or adjacent to the exterior of the machine 1. The user interface 3 may be configured to allow the user to make selections that result in a preferred aerosol precursor being dispensed to the user. For example, the user may personalize the flavor and strength (e.g. nicotine content) of their aerosol precursor though the use of a plurality of options and menus displayed on the user interface 3. The user interface 3 may be a touchscreen. Alternatively, the user interface 3 may include a display separate from an input device, such as a keypad.

The machine 1 may also include an aperture 5 for dispensing the desired product to the user. The aperture 5 may include a door, flap, valve, or other structure that selectively opens when the product is ready to be retrieved or received by the user. The desired product dispensed from the machines 1 may take several forms. The product may be provided as the aerosol precursor itself, preferably a liquid, a cartridge containing the precursor, or a package of one or more cartridges containing the precursor.

The machine 1 can have an access panel 7 to allow maintenance personnel or retailers to access the interior of the machine 1 to perform maintenance, updates, or to restock the machine 1 with the raw materials necessary to perform the machine's operations. The access panel 7 is shown as a door on the front of the machine 1. The access panel 7 should not be limited to hinged doors, but may include any other suitable closure. The access panel 7 is shown on the front of the machine 1, but the access panel 7 may be placed in any other suitable location based upon the desire to provide access to the internal mechanisms of the machine 1. Therefore, the configuration of the access panel 7 may be driven by the arrangement of the internal components of the machine 1. While a single access panel 7 is shown in FIG. 1, it should be well understood that the machine 1 may include a plurality of separate access panels 7 to provide for the necessary internal access.

The machine 1 may include a variety of other ports, plugs, scanners, readers and other devices operably accessible to the user. For example, the machine 1 may include readers 4 such as scanners, readers, sensors, cameras, etc. for bar codes, QR codes, magnetic strips, RFID, and other optical and electromagnetic identification, which may be used to provide information to the machine 1. In one embodiment, the machine 1 may be configured to determine the identity of the user through identification cards, such as a driver's license or an employee badge. The machine 1 may include cameras recording the user to help avoid theft or apprehend vandals. The machine 1 may have a reader for codes on coupons or other brochures. For example, the store may wish to advertise the favorite aerosol precursor recipes of their employees. These recipes may be indicated by bar codes that can be scanned by the user to have the machine 1 dispense the pre-determined recipe. Users may have their own preferences stored on key tags or other internal or external storage medium, such as memory, that can be read by the machine 1 to expedite the vending of the customer's preferred aerosol precursor. In one example the customer's recipe may be created using a website or mobile application. The customer's smart phone may then be programmed to display a corresponding bar code that can be read by a bar code reader provided within the machine 1. Other readers may facilitate the direct purchase of the desired product directly from the machine 1 with credit card readers, cash acceptance means, or other devices for accepting payment known in the art.

In one embodiment, the machine 1 may include ports or plugs that allow the user to recharge a power unit 210 of their aerosol delivery device 200 (see FIG. 7) while the machine 1 is preparing their personalized precursor.

One skilled in the art should understand that the machine 1 may have one or more ports, plugs, or devices to facilitate operation of the machine 1 that are not intended to be user accessible or user-facing. This may include items like power cords for providing the machine 1 with power, or Ethernet ports to allow the machine 1 to network with remote databases on the world wide web or as part of the retail location's operations. For example, the machine 1 may be linked to a store's register so that the machine 1 will only dispense the desired product after the customer has paid for the product, or after the sales clerk has verified the age or other identifying characteristics of the user.

The machine 1 may be able to store a consumer's preferences to streamline the dispensing process. The machine 1 may be networked to other machines, networked to the internet, or provided with reader technology so that a customer may receive their preferred precursor without returning to the same machine each time or making a full set of selections on the user interface 3.

In one embodiment, bluetooth or similar close proximity data transfer technology (e.g. near field communication (NFC) technology) may be used by the machine 1 to receive or retrieve preferences from a consumer's smart phone. As a result, the customer's customized aerosol precursor can be selected on-the-go or at home, saving the customer time while standing in front of the machine. This process may involve an app installed on the phone to sync with the machine. The process of interaction between the machine 1 and the smart phone or aerosol delivery device may be consistent with the methods described in U.S. patent application Ser. No. 14/327,776 filed Jul. 10, 2014 to Ampolini, which is incorporated herein by reference.

The machine 1 may have a variety of security features. In one example the machine 1 may be operatively connected to DMV databases so that the machine may read the user's identification and limit operation of the machine 1 to qualified customers, store personnel, or other defined users. Other security features may include cameras or only dispensing precursor in childproof containers.

The non-user-facing ports may also include inlets for raw materials used within the machine 1. Raw materials generally include components of the precursor, empty cartridges, if provided, and packaging materials, if provided. In some embodiments, all or some of the raw materials used in the machine's processes are held within the machine 1. In another example, raw materials may be received through the inlet from an auxiliary or external storage location that increases the capacity of the machine 1. This would be especially useful for storing components common to all aerosol precursor, or products, dispensed by the machine 1. For example, aerosol former, such as a polyol, may be initially stored in a remote auxiliary tank. In other embodiments, raw materials may be received from a common source. For example, where water is used as an aerosol former, the machine 1 may include an inlet for filtered water.

FIG. 2 schematically illustrates an example set of internal components from the machine 1.

In some embodiments, the machine 1 includes a filling system 10, a packaging system 50 (see FIG. 3), and a vending system 80. In one example aerosol precursor is filled into empty cartridges by the filling system 10, the filled cartridges are packed into appropriate packaging by the packaging system 50, and the packaged product is discharged from the machine 1 by the vending system 80. In other embodiments, the packaging system 50 may be omitted or by-passed as the machine 1 vends filled cartridges ready for immediate use without a separate protective package. In yet other embodiments, the vending system 80 simultaneously acts as the filling system 10. For example, the machine 1 may dispense the aerosol precursor in liquid form directly into a cartridge externally and removably attached to the machine 1.

As used herein, the term "cartridge" is used as a device that is operatively engageable with a power unit 210 to form an aerosol delivery device 200. An example cartridge 204 is shown in FIG. 7. The cartridge may be intended to be filled once and discarded, or the cartridge may be intended to be re-filled repeatedly as the precursor is consumed. In some embodiments, cartridges may merely comprise tanks or reservoirs that hold precursor. In other embodiments, as discussed below, cartridges 204 may have a reservoir layer or portion, in addition to other features used to generate aerosol from the precursor.

The filling system 10 provides aerosol precursor. As discussed in more detail below, the aerosol precursor generally has several individual components that may be generally classified into three primary groups when producing a precursor for a smoking article, these are: nicotine sources, aerosol formers, and flavoring agents (collectively "precursor components") that may be stored in first sources 12, second sources 14 and third sources 16 respectively within the machine 1. In some embodiments, the machine 1 is configured to dispense an aerosol precursor having an aerosol former, a selectable relative strength of nicotine (i.e. amount of nicotine source) and an optional one or more flavoring agents provided with optionally selectable strength.

In one example, each of the selectable components is provided in a liquid form. In other examples, some components may be provided in particle, or other solid, form. The sources 12, 14, 16 may comprise re-fillable storage tanks for holding the precursor components. The sources 12, 14, 16 may also comprise disposable modules where, when the precursor component is consumed, the module package is replaced. Each disposable module may be configured to contain a large plurality of doses of its respective aerosol precursor composition or component. In other embodiments, each disposable module may provide a single-dose of the respective aerosol precursor composition or component. Some components can be provided in multi-dose modules and other components can be provided in single-dose modules.

The sources 12, 14, 16 may lead to a material transmission sub-system 18 configured to selectively transmit the desired precursor components to a filling head 20. The transmission sub-system 18 may be characterized by a plurality of pumps and valves that selectively pull materials from the sources 12, 14, 16 or otherwise allow component liquids from the sources to be released and conveyed to the filling head 20. The filling head 20 may include a manifold in which each of the precursor components is mixed prior to filling a cartridge 204 or dispensing the aerosol precursor. The manifold may be subject to agitation, include a stirring mechanism, or include other means to actively mix the precursor components prior to filling them into the cartridge 204.

In other embodiments, the individual precursor components may be separately provided into the cartridge 204 in successive steps or simultaneously from individual filling heads 20. In an embodiment, the filling system 10 includes an agitator to shake the cartridge 204. The agitator may be provided to mix the precursor components 12, 14, 16 within the cartridge 204. Agitation may also help facilitate a more complete or uniform saturation of the cartridge's reservoir. 244 with aerosol precursor.

In other embodiments, the individual precursor components may be separately provided into separate sections or reservoirs 244 within the cartridge 204 itself. When a plurality of separate reservoirs 244 is utilized, a variety of combinations of separate precursor components may be stored in the reservoirs. In some embodiments, a substantially complete aerosol precursor composition may be stored in two or more separate reservoirs. In some embodiments, aerosol formers (e.g., glycerin, propylene glycol, and water) may be stored in one or more reservoirs and one or more flavors may be stored in one or more further reservoirs. In some embodiments, aerosol formers may be stored in one or more reservoirs, a nicotine source may be stored in one or more further reservoirs, and optional additional flavors may be stored in one or more optional additional reservoirs (although the optional flavors may be combined with the nicotine and/or the aerosol former). Other combinations of materials stored in separate reservoirs are also encompassed, and such ability to separately store the components can provide for precise control of aerosol composition that is provided as controlled by the power unit 210 and the aerosol generating means (e.g. atomizer 232) within the cartridge itself. In particular, aerosol composition may be adjusted as desired so that liquid is only drawn from the specific reservoirs 244 required to provide the desired aerosol composition in a specific puff on an aerosol delivery device 200.

In one embodiment, the filling head 20 may take the form of one or more pipetting assemblies 30 as schematically presented in FIG. 5. The pipetting assembly 30 may comprise a chamber 32 having an elongated body capable of holding and dispensing a liquid, such as the aerosol precursor or components thereof. Chamber 32 has an open proximal end 34 and an opposing distal end 36 that has a tapered tip 38 with a passageway 40 formed therethrough. One end of passageway 40 opens into chamber 32 to provide communication between the tip 38 and the chamber 32 and the opposing end of passageway 40 is open, such that liquid can pass therethrough and be dispensed through a cannula 42 that is coupled to tip 38. A biasing member 44 is provided, which is adapted such that one (top) end of the spring element is situated around the diameter of pipette assembly 30 (e.g., around tip 38, as illustrated), encircling the diameter of the pipette assembly, and extending vertically downward. Further examples of exemplary pipettes and features thereof are described in U.S. patent application Ser. No. 14/646,078, filed Aug. 20, 2014, which is incorporated herein by reference.

The pipette assemblies 30 of FIG. 5 may be beneficial in filing containers comprising one or more solid or semi-solid materials, such as reservoir-containing cartridges 204, as will be described in greater detail below. Where the containers to be filled comprise a solid or semi-solid material, the cannula 42 used to fill the container generally experiences some friction when it comes into contact with that material, which must be overcome to dispense the liquid and to withdraw the cannula 42 from the container. As the cannula 42 is withdrawn from the container, the end of biasing member 44 (or the restraining component associated therewith) remains engaged with the top diameter of the container, such that the containers are not displaced vertically upwards upon withdrawal of the cannula. Such pipette assemblies can be applicable with regard to both top down and bottom up dispensing of the liquid.

The filling head 20 may take other configurations. For example, the filling head 20 may include a nozzle or other outlet configured to spray the aerosol precursor into the cartridges. The spray may vary from a relative mist to a concentrated jet of aerosol precursor.

The filling system 10 should be constructed to provide a dosed amount of precursor into each cartridge 204. Any or all of the subsystems of the filling system 10 may contribute to the dosed filling. For example, the transmission subsystem 18 may only draw or allow a very specific amount of each component to leave each source 12, 14, 16. Further, the filling head 20 may be configured to dispense only a specific volume of fluid. In some cases, these sub-systems may need to work together to properly fill each desired cartridge 204. In one embodiment, a user may desire to purchase a 6-pack of cartridges. The transmission sub-system 18 may draw the required amount of each component fluid to fill all six of the cartridges at one time. The filling head 20 would then dose the full 6-pack batch into the individual cartridges. In other embodiments, the transmission sub-system 18 may allow for the simultaneous creation of one or more doses.

Where multiple filling heads 20 are provided, each filling head 20 may dispense from a common manifold, in which case a 6-pack of cartridges having the same contents may be more quickly generated. In other embodiments, multiple filling heads 20 may each dispense from a separate manifold. Therefore a 6-pack of cartridges could be quickly filled without having the same aerosol precursor recipe in each cartridge of the same 6-pack.

The filling system 10 should also include an ability to select and position the cartridge 204 into which the aerosol precursor is going to be filled. In a preferred embodiment, the machine 1 should be reloadably stocked with cartridges 204 for use with aerosol delivery devices 200 or smoking articles. As discussed below, cartridges 204 have been disclosed and marketed that have a variety of configurations. In one embodiment, the machine 1 will be stocked with a variety of cartridge types, sizes, and configurations. This way, the user may select the suitable cartridge, or select among several suitable cartridges (based on volume or performance) that are known to be compatible with the control body 202 of the user's smoking article. In other embodiments, only a single type of cartridge may be filled for any given machine 1. Additionally or alternatively, the machine 1 may be configured to accept reusable cartridges that are provided by the user. In this embodiment the reusable cartridge may be refilled and dispensed back to the user. In yet other embodiments, a user may deposit a used cartridge into the machine 1, where the used cartridges may be collected for recycling, cleaning or refurbishment, as the machine 1 dispenses a different cartridge filled with aerosol precursor back to the user.

In one embodiment, the filling system 10 includes a cartridge transport sub-system 46. The cartridge transport sub-system 46 is configured to position the selected empty cartridge into the proper location and orientation to be filled by the filling head 20. In the illustrated figures, the cartridge transport sub-system 46 is shown as including a slideable platform. Any known mechanism may be used to implement the cartridge transport sub-system 46. For example, cartridges 204 may be moved from their staging location to the filling head 20 by a gravity-fed set of shoots where an actuator is configured to release the selected number of cartridges to be filled. Cartridges may be moved by other means such as a robotic arm or other device that grips and moves each cartridge into place.

As discussed above, the machine 1 may fill the cartridges externally. For purposes of these embodiments, "externally," can mean, within reach of the user. In these embodiments, the cartridge transport sub-system 46 may be omitted or by-passed as the user. In other words, the user could be required to themselves correctly position a cartridge with respect to a filling head 20. The cartridge could be a spent, reusable cartridge. Alternatively, the user could receive a new, empty cartridge, from a clerk or by selection from a display near the machine 1, and then the machine 1 may fill the cartridge after the user has correctly positioned it within or proximate to the machine 1.

The filling system 10 may also include a completion sub-system 48. The completion sub-system 48 may vary based upon the type of cartridge being filled, but the goal of the completion sub-system 48 would be to complete or otherwise seal the cartridge so that the aerosol precursor is preserved within the respective reservoir. In one example, a cap, such as a mouthpiece may be screwed or otherwise attached on an end of a cartridge. Another cartridge is described in U.S. App. Pub. 2014/0261408 published Sep. 18, 2014 to DePiano et al, which is incorporated herein by reference.

If the precursor is used in a cartridge, the machine 1 may also include a programming unit 49 to program the cartridge with the heating set-point and other pertinent configuration parameters such as heating profile, puff durations, puff length, expiration date, etc. for use by the power unit 210 of the aerosol delivery device 200 to optimize the cartridge for the specific precursor composition. The programming unit may include a microprocessor, a transmitter or other known elements setting the operational parameters of the power unit 210.

After filling the desired type and quantity of cartridges with the desired volume and recipe of aerosol precursor, and after completing each cartridge, if necessary, the filled cartridges may progress to a packaging system 50. An example packaging system 50 is schematically illustrated in FIG. 3. The packaging system 50 may take a variety of forms and be configured to package the filled cartridges into any suitable package known in the art. In one example, the cartridges may be sealed into "blister packs."

An example blister pack 104 is shown in FIG. 6. A tray 106 may define an upper surface 108 with a plurality of cups 110 extending down from the upper surface 108. The tray 106 may be translucent or transparent to allow a user to see therethrough. The filled cartridges may be manipulated such that each cartridge rests in a respective cup 110. A cover 112 may be positioned opposite the upper surface 108 of the tray 106. The cover 112 may comprise a thin layer or film of foil or plastic. In use, the cover 112 is intended to be ruptureable so that application of an external force to each cup 110 with result in the cartridge 204 rupturing a corresponding portion of the cover 112 to provide access to the filled cartridge.

Other example blister packs are described in U.S. Pat. App. Pubs. 2014/0001194 published Jan. 2, 2014 and 2014/0251842 published Sep. 11, 2014, both to Pipes, which are incorporated herein by reference.

The packaging system 50 may include a sealing sub-system 60, an example of which is shown in FIG. 4. The sealing sub-system 60 may seal the blister packs 104 by using heat to fuse the cover 112 to the upper surface 108, resulting in a sealed cavity 114 housing the filled cartridge 204. The sealing sub-system 60 may use other mechanisms to form a sealed package depending upon the type of package being used. Sealing could be performed by light, or pressure, in addition to or instead of heat. Sealing may further include means to create a full or partial vacuum.

In other embodiments, the packaging system 50 may include a variety of other sub-systems. For example, additional layers of packing may be provided by other sub-systems. The blister pack 104 may be wrapped by an outer packaging, or slid into a sleeve or other exterior packaging.

The packaging system 50 may also include a printing station 65. The printing station 65 may print directly on the package, may print onto a label that is fixed, e.g. adhered, to the package, or may print a receipt to accompany the blister pack 104. The printing station 65 may be configured to provide any information common to a product label. Examples include information about the contents of the package, such as the type or brand of the cartridge, a generic description or summary of the customized precursor or user selections that produced the aerosol precursor used, an identifier of the user for which the package was prepared, price information based on the cartridges, contents and quantity thereof, bar codes, or QR codes that reflect the same, etc.

The packaging system 50 is preferably configured to package a variety of quantities of filled cartridges. For example, the user may have the ability to request a single cartridge, or a multi-pack, such as a three-pack or six-pack. The packaging system 50 may have separate packing blanks for each of the package sizes selectable by a user. In the embodiment of FIG. 6, the trays 106 and covers 112 of the blister packs 104 may be provided in continuous rolls that can be separated between cups 110 with using an internal, automated cutting or tearing device, or by the user as the filled cartridges are dispensed from the machine 1.

In some embodiments, cartridges can have a pre-installed cap on the mouthpiece end thereof. In these and other embodiments, the packaging system 50 may be omitted or by-passed in some embodiments so that the filled cartridges are provided directly to the user via a vending system 80. By-passing the packaging system 50 may be an option selected by the user when operating the machine 1. By-passing the packaging system 50 may be preferred when the cartridge 204 is being dispensed for immediate use. For example, the machine 1 may be employed in a smoking or vaping lounge where the user can create their custom-filled cartridge and then remain in the lounge to enjoy the product.

The vending system 80 of the machine 1 may be generally described as the means to provide the user with access to the selected aerosol precursor, the filled cartridge, or the packaged filled cartridge in each of the various embodiments. The vending system 80 may be a shoot 82 down which the packaged cartridges fall. The vending system 80 may have a cover panel that is selectively openable to control access to the packaged cartridges. The vending system 80 may include any necessary means to convey the finished product to the user. Many of the devices discussed above with respect to the transportation of empty cartridges may be useful for conveying filled cartridges or packaged cartridges from within the machine 1 to an access aperture 5 for the user.

Although a variety of systems and individual components of the dispensing machine 1 are presently described herein it is understood that one or more further systems and/or components may be added. Likewise, it is understood that one or more systems and/or components may be omitted and/or may be replaced with further suitable systems and/or components. For example, apparatuses and methods for manufacturing small quantities of cigarettes are known in the art and include exemplary systems and components that may be added to, or adapted for use in, the presently disclosed dispensing machine. An example of such cigarette manufacturing apparatus is described in U.S. Pat. No. 7,565,818 to Thomas et al., the disclosure of which is incorporated herein by reference.

Use of the machine 1 as described above may be further disclosed in terms of a method of forming an aerosol precursor. The method may include making a selection from a machine comprising a plurality of sources of dispensable, liquid aerosol precursor components, the plurality of sources differing in the liquid aerosol precursor components dispensable therefrom, wherein making the selection comprises, using a user interface of the machine to define a custom combination of the aerosol precursor components from the plurality of sources. The method may also include dispensing the aerosol precursor composition formed of the custom combination of the aerosol precursor components arising from the selection made on the user interface.

In some embodiments, the step of dispensing further comprises dispensing the aerosol precursor from a filling head into a reservoir within a cartridge usable with an aerosol delivery device. The method may include a step of packaging the cartridge after the cartridge receives aerosol precursor from the filling head. In some embodiments making the selection comprises selecting an aerosol former of the custom combination. In an embodiment, making the selection comprises selecting a relative amount of nicotine within the custom combination. In another embodiment making the selection comprises selecting at least one flavoring agent for use within the custom combination.

Whether dispensed directly, or in the form of a filled cartridge, the machine 1 is configured to vend aerosol precursor and is preferably configured to vend aerosol precursor as a personalized choice based upon user selections.

The aerosol precursor is not particularly limited. Several optional characteristics of representative precursor are discussed below. The aerosol precursor is composed of a combination or mixture of various ingredients (i.e. components). The selection of the particular aerosol precursor components, and the relative amounts of those components used, may be altered based on user input at the user interface 3 in order to control the overall chemical composition of the mainstream aerosol produced by the atomizer 232 of the aerosol delivery device 200. Of particular interest are aerosol precursors that can be characterized as being generally liquid in nature. For example, representative generally liquid aerosol precursors may have the form of liquid solutions, mixtures of miscible components, or liquids incorporating suspended or dispersed components. Typical aerosol precursors are capable of being vaporized upon exposure to heat under those conditions that are experienced during use of the aerosol delivery devices 200 that are characteristic of the current disclosure; and hence are capable of yielding vapors and aerosols that are capable of being inhaled.

For aerosol delivery devices 200 that are characterized as electronic cigarettes, the aerosol precursor most preferably incorporates tobacco or components derived from tobacco (referred to herein as "nicotine sources") which may be provided within first sources 12. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

The aerosol precursor may incorporate a so-called "aerosol former" component that may be provided within second sources 14. Such materials have the ability to yield visible aerosols when vaporized upon exposure to heat under those conditions experienced during normal use of atomizers 232 that are characteristic of the current disclosure. Such aerosol forming materials include various polyols or polyhydric alcohols (e.g., glycerin, propylene glycol, and mixtures thereof). Many embodiments of the present disclosure incorporate aerosol precursor components that can be characterized as water, moisture or aqueous liquid. During conditions of normal use of certain aerosol delivery devices 200, the water incorporated within those devices can vaporize to yield a component of the generated aerosol. As such, for purposes of the current disclosure, water that is present within the aerosol precursor may be considered to be an aerosol forming material.

A variety of optional flavoring agents or materials that alter the sensory character or nature of the drawn mainstream aerosol comprise the optional third major component of the aerosol precursor, and may be provided within third sources 16. For example, such optional flavoring agents may be selectively added within the aerosol precursor to alter the flavor, aroma and organoleptic properties of the aerosol. Certain flavoring agents may be provided from sources other than tobacco. Exemplary flavoring agents may be natural or artificial in nature, and may be employed as concentrates or flavor packages.

Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar and pipe tobaccos. Syrups, such as high fructose corn syrup, also can be employed. Certain flavoring agents may be incorporated within aerosol forming materials prior to formulation of a final aerosol precursor mixture (e.g., certain water soluble flavoring agents can be incorporated within water, menthol can be incorporated within propylene glycol, and certain complex flavor packages can be incorporated within propylene glycol).

Aerosol precursors also may include ingredients that exhibit acidic or basic characteristics (e.g., organic acids, ammonium salts or organic amines). These ingredients may be included in the general description of the flavoring agents 16 for the purpose of this disclosure. For example, certain organic acids (e.g., levulinic acid, succinic acid, lactic acid, and pyruvic acid) may be included in an aerosol precursor formulation incorporating nicotine, preferably in amounts up to being equimolar (based on total organic acid content) with the nicotine. For example, the aerosol precursor may include about 0.1 to about 0.5 moles of levulinic acid per one mole of nicotine, about 0.1 to about 0.5 moles of succinic acid per one mole of nicotine, about 0.1 to about 0.5 moles of lactic acid per one mole of nicotine, about 0.1 to about 0.5 moles of pyruvic acid per one mole of nicotine, or various permutations and combinations thereof, up to a concentration wherein the total amount of organic acid present is equimolar to the total amount of nicotine present in the aerosol precursor.

As one non-limiting example, a representative aerosol precursor created by the machine 1 at the request of the user can have the form of a mixture of about 70% to about 90% glycerin, often about 75% to about 85% glycerin; about 5% to about 20% water, often about 10% to about 15% water; about 1% to about 10% propylene glycol, often about 4% to about 8% propylene glycol; about 0.1% to about 6% nicotine, often about 1.5% to about 5% nicotine; and optional flavoring agent in an amount of up to about 6%, often about 0.1% to about 5% flavoring agent; on a weight basis. For example, a representative aerosol precursor may have the form of a formulation incorporating greater than about 76% glycerin, about 14% water, about 7% propylene glycol, about 1% to about 2% nicotine, and less than about 1% optional flavoring agent, on a weight basis. For example, a representative aerosol precursor may have the form of a formulation incorporating greater than about 75% glycerin, about 14% water, about 7% propylene glycol, about 2.5% nicotine, and less than about 1% optional flavoring agent. For example, a representative aerosol precursor may have the form of a formulation incorporating greater than about 75% glycerin, about 5% water, about 8% propylene glycol, about 6% nicotine, and less than about 6% optional flavoring agent, on a weight basis.

Representative types of aerosol precursor components and formulations are also set forth and characterized in U.S. Pat. No. 7,726,320 to Robinson et al. and U.S. Pat. Pub. Nos. 2013/0008457 to Zheng et al.; 2013/0213417 to Chong et al. and 2014/0060554 to Collett et al., 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC. Embodiments of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; and U.S. Pat. No. 7,381,667 to Bergquist et al., as well as U.S. Pat. Pub. Nos. 2006/0191548 to Strickland et al.; 2009/0025741 to Crawford et al; 2010/0018539 to Brinkley et al.; and 2010/0170522 to Sun et al.; and POT WO 97/06786 to Johnson et al., all of which are incorporated by reference herein.

The amount of aerosol precursor that is incorporated within the aerosol delivery device 200 is such that the atomizer 232 provides acceptable sensory and desirable performance characteristics. For example, it is highly preferred that sufficient amounts of aerosol former (e.g., glycerin and/or propylene glycol), be employed in order to provide for the generation of a visible mainstream aerosol that in many regards resembles the appearance of tobacco smoke. The amount of aerosol precursor may be dependent upon factors such as the number of puffs desired. Typically, the amount of aerosol precursor incorporated within the aerosol delivery device 200, and particularly within the cartridge 204, is less than about 2 g, generally less than about 1.5 g, often less than about 1 g and frequently less than about 0.5 g.

In many embodiments, the machine 1 is configured to provide the aerosol precursor to the user in the form of a filled cartridge 204 for use with a smoking article or aerosol delivery device 200. FIG. 7 shows an example aerosol delivery device 200 having an example cartridge 204 that could be filled and dispensed by the machine of the present disclosure. As seen in the cross-section illustrated therein, the aerosol delivery device 200 can comprise a control body 202 and a cartridge 204 that can be permanently or detachably aligned in a functioning relationship. Although a threaded engagement is illustrated in FIG. 7, it is understood that further means of engagement are encompassed, such as a press-fit engagement, interference fit, a magnetic engagement, or the like.

In specific embodiments, one or both of the control body 202 and the cartridge 204 may be referred to as being disposable or as being reusable. For example, the control body 202 may have a replaceable battery or may be rechargeable and thus may be combined with any type of recharging technology, including connection to a typical electrical outlet, connection to a car charger (i.e., cigarette lighter receptacle), and connection to a computer, such as through a USB cable.

In the exemplified embodiment, the control body 202 includes a control component 206, a flow sensor 208, and a power unit 210, which can be variably aligned, and can include a plurality of indicators 212 at a distal end 214 of an external shell 216. The indicators 212 can be provided in varying numbers and can take on different shapes and can even be an opening in the body (such as for release of sound when such indicators are present).

An air intake 218 may be positioned in the external shell 216 of the control body 202. A receptacle 220 also is included at the proximal attachment end 222 of the control body 202 and extends into a control body projection 224 to allow for ease of electrical connection with an atomizer 232 or a component thereof, such as a resistive heating element 234 when the cartridge 204 is attached to the control body 202.

The cartridge 204 includes an external shell 226 with a mouth opening 228 at a mouth end 230 thereof to allow passage of air and entrained vapor (i.e., the components of the aerosol precursor composition in an inhalable form) from the cartridge to a consumer during draw on the aerosol delivery device 200. The aerosol delivery device 200 may be substantially rod-like or substantially tubular shaped or substantially cylindrically shaped in some embodiments.

The cartridge 204 further includes an atomizer 232 comprising a resistive heating element 234 comprising a wire coil in the illustrated embodiment and a liquid transport element 236 comprising a wick in the illustrated embodiment and configured to transport the precursor. Various embodiments of materials configured to produce heat when electrical current is applied therethrough may be employed to form the wire coil. Example materials from which the wire coil may be formed include Kanthal (FeCrAl), Nichrome, Molybdenum disilicide (MoSi2), molybdenum silicide (MoSi), Molybdenum disilicide doped with Aluminum (Mo(Si,Al)2), and ceramic (e.g., a positive temperature coefficient ceramic). Electrically conductive heater terminals 238 (e.g., positive and negative terminals) at the opposing ends of the heating element 234 are configured to direct current flow through the heating element and configured for attachment to the appropriate wiring or circuit (not illustrated) to form an electrical connection of the heating element with the power unit 210 when the cartridge 204 is connected to the control body 202. Specifically, a plug 240 may be positioned at a distal attachment end 242 of the cartridge 204. When the cartridge 204 is connected to the control body 202, the plug 240 engages the receptacle 220 to form an electrical connection such that current controllably flows from the power unit 210, through the receptacle and plug, and to the heating element 234. The external shell 226 of the cartridge 204 can continue across the distal attachment end 242 such that this end of the cartridge is substantially closed with the plug protruding therefrom.

A reservoir 244 may utilize a liquid transport element 236 to transport an aerosol precursor composition to an aerosolization zone. The cartridge 204 includes a reservoir 244 comprising layers of nonwoven fibers formed into the shape of a tube encircling the interior of the external shell 226 of the cartridge, in this embodiment. An aerosol precursor composition provided by the machine 1 may be retained in the reservoir 244. Liquid components, for example, can be absorptively retained by the reservoir 244. The reservoir 244 is in fluid connection with a liquid transport element 236 (the wick in this embodiment). The liquid transport element 236 transports the aerosol precursor composition stored in the reservoir 244 via capillary action to an aerosolization zone 246 of the cartridge 204. As illustrated, the liquid transport element 236 is in direct contact with the heating element 234 that is in the form of a metal wire coil in this embodiment.

In use, when a user draws on the aerosol delivery device 200, the heating element 234 is activated (e.g., such as via a puff sensor), and the components for the aerosol precursor composition are vaporized in the aerosolization zone 246. Drawing upon the mouth end 230 causes ambient air to enter the air intake 218 and pass through the central opening in the receptacle 220 and the central opening in the plug 240. In the cartridge 204, the drawn air passes through a first air passage 248 in a first air passage tube 250 and combines with the formed vapor in the aerosolization zone 246 to form an aerosol. The aerosol is whisked away from the aerosolization zone 246, passes through a second air passage 252 in a second air passage tube 254, and out the mouth opening 228.

The reservoir 244 can comprise various different materials and can be formed in a variety of different manners. In one embodiment the reservoir 244 can be formed from a plurality of combined layers that can be concentric or overlapping. For example, the reservoir 244 can be a continuous sheet of a material that is rolled to form the hollow tubular configuration. In other embodiments, the reservoir 244 can be substantially a unitary component. For example, the reservoir 244 can be shaped or molded so as to be a singular preformed element in the form of a substantially hollow tube, which may be substantially continuous in composition across the length and thickness thereof.

The reservoir 244 can be formed from a material that is rigid or semi-rigid in some embodiments, while retaining the ability to store a liquid product such as, for example, an aerosol precursor composition. In certain embodiments, the material of the reservoir 244 can be absorbent, adsorbent, or otherwise porous so as to provide the ability to retain the aerosol precursor composition. As such, the aerosol precursor composition can be characterized as being coated on, adsorbed by, or absorbed in the material of the reservoir 244. The reservoir 244 can be positioned within the cartridge 204 such that the reservoir 244 is in contact with the liquid transport element 236. More particularly, the reservoir 244 can be manufactured from any material suitable for retaining the aerosol precursor composition (e.g., through absorption, adsorption, or the like) and allowing wicking away of the precursor composition for transport to the heating element 234.

The material of the reservoir 244 can be heat resistant so as to retain its structural integrity and avoid degradation at least at a temperature proximal to the heating temperature provided by the heating element 234. However, the reservoir 244 need not be heat resistant to the full temperature produced by the heating element 234 due to the reservoir being out of contact therewith. The size and strength of the reservoir 244 may vary according to the features and requirements of the cartridge 204. In particular embodiments, the reservoir 244 can be manufactured from a material suitable for a high-speed, automated manufacturing process. Such processes may reduce manufacturing costs compared to traditional woven or non-woven fiber mats. According to one embodiment, the reservoir 244 can be manufactured from a cellulose acetate tow which can be processed to form a hollow acetate tube.

Further details of the example aerosol delivery device 200 and cartridge 204 are disclosed in U.S. 2014/0261408 published Sep. 18, 2014 to Depiano et al, and incorporated herein by reference. Other cartridges that may be suitable for use with the disclosed machine 1 are described in U.S. Pat. App. Pubs. 2014/0332020 to Li et al and 2014/0246016 to Terry, 2013/0192619 to Tucker, 2013/0192620 to Tucker, as well as U.S. Pat. No. 8,794,231 to Thorens and U.S. Pat. No. 8,707,965 to Newton, all of which are incorporated herein by reference. Suitable cartridges may also be described in WO 2013/159245 to Hon, and WO 2012/173322 to Kim, as well as U.S. patent application Ser. No. 14/530,275, filed Oct. 31, 2014 to Bless et al, all of which are incorporated herein by reference. Other cartridges may have a single-use connector as described in U.S. Pat. No. 8,910,639, to Chang, which incorporated herein by reference.

The foregoing description of use of the machine can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A machine for dispensing an aerosol precursor composition for use with aerosol delivery devices including a control body and a cartridge, the machine comprising:

a plurality of sources of dispensable, liquid aerosol precursor components, the plurality of sources differing in the liquid aerosol precursor components dispensable therefrom;

a user interface configured to allow a user to select an amount of the liquid aerosol precursor components for dispensing;

a dispenser configured to dispense the aerosol precursor components into the cartridge in response to the selection made on the user interface;

a computer programming device comprising a hardware processor and being in communication with the user interface or the dispenser, the computer programming device being configured to interact with a power unit of the control body to program the power unit with operational parameters corresponding to the aerosol precursor components selected and dispensed into the cartridge from the dispenser, wherein the operational parameters comprise one or more of a heating profile, puff durations, puff length, or expiration date; and a vending system comprising a chute through which the cartridge having the dispensed aerosol precursor composition therein is conveyed, the vending system comprising an access aperture in communication with the chute through which the dispensed aerosol precursor components are configured to be conveyed for access by the user.

2. The machine of claim 1, comprising at least one source of an aerosol former.

3. The machine of claim 2, wherein the aerosol former comprises a material selected from the group consisting of polyols, water, and combinations thereof.

4. The machine of claim 1, comprising at least one source of a flavoring agent.

5. The machine of claim 1, comprising at least one source of nicotine.

6. The machine of claim 1, wherein the plurality of sources include replaceable pre-filled storage modules insertable into the machine, and containing an aerosol precursor component.

7. The machine of claim 1, wherein the plurality of sources includes refillable storage tanks disposed within the machine.

8. The machine of claim 1, wherein the plurality of sources includes an inlet in operable communication with an external source.

9. The machine of claim 1, wherein the dispenser is configured to dispense the aerosol precursor components in a manner that the selected components mix to form the customizable aerosol precursor composition.

10. The machine of claim 1, wherein the dispenser is configured to dispense the aerosol precursor components in a manner that the selected components remain separate until combined during use of the aerosol delivery device.

11. The machine of claim 1, wherein the dispenser is configured to dispense the aerosol precursor components into at least one reservoir of a cartridge based upon the user selection.

12. The machine according to claim 11, wherein the dispenser comprises at least one pipette assembly.

13. The machine according to claim 11, further comprising empty cartridges stocked within the machine.

14. The machine according to claim 13, further comprising a cartridge transport system configured to position one or more empty cartridges in relation to the dispenser to accept the dispensed aerosol precursor components.

15. The machine according to claim 13, wherein the empty cartridges comprise a plurality of cartridge sizes or types, and the user interface allows the user to select a preferred cartridge to be filled.

16. The machine according to claim 11, further comprising:

a packaging system for packing one or more cartridges having received the selectively dispensed aerosol precursor components.

17. The machine according to claim 16, wherein the machine includes a tray portion and a cover film for use in the packaging system to create a blister pack.

18. The machine according to claim 17, wherein the packaging system includes a sealing sub-system to seal the cover film to the tray portion.

19. The machine according to claim 18, wherein the packaging system provides packages containing more than one cartridge, each cartridge sealed in a respective cup of the blister pack.

20. The machine according to claim 16, wherein the machine further comprises a printing sub-system configured to print a label to accompany the packaged cartridges.

* * * * *